US006450428B1

(12) United States Patent
Kelsey

(10) Patent No.: US 6,450,428 B1
(45) Date of Patent: Sep. 17, 2002

(54) FEED ARRANGEMENT FOR GRINDING MILL INCORPORATING FLUID FEED

(75) Inventor: Christopher George Kelsey, Hope Forrest (AU)

(73) Assignee: Lowan (Management) Pty Limited, South Australia (AU)

( * ) Notice: Subject to any disclaimer, the term of this patent is extended or adjusted under 35 U.S.C. 154(b) by 0 days.

(21) Appl. No.: 09/559,326

(22) Filed: Apr. 27, 2000

(30) Foreign Application Priority Data

May 5, 1999 (AU) ..... PQ0144
Jul. 28, 1999 (AU) ..... PQ1879

(51) Int. Cl.[7] ..... B02C 17/00
(52) U.S. Cl. ..... 241/172; 241/15
(58) Field of Search ..... 241/172, 176, 241/177, 178, 15, 16, 20, 24.1, 24.11

(56) References Cited

U.S. PATENT DOCUMENTS 3,056,561 A 10/1962 Hukki ..... 241/172
5,011,089 A 4/1991 Vock et al. ..... 241/21
5,158,239 A 10/1992 Vock et al. ..... 241/172
5,312,055 A 5/1994 Barthelmess et al. ..... 241/172
5,820,040 A * 10/1998 Hockmeyer et al. ..... 241/172
5,984,213 A * 11/1999 Woodall et al. ..... 241/172
6,019,300 A * 2/2000 Zoz ..... 241/172

FOREIGN PATENT DOCUMENTS

| | | |
|---|---|---|
| DE | 196 14295 | 10/1996 |
| FR | 1289073 | 8/1962 |
| FR | 2631253 | 11/1989 |
| SU | 1045926 | 10/1983 |
| WO | WO 99/11377 | 3/1999 |

* cited by examiner

*Primary Examiner*—Ed Tolan
(74) *Attorney, Agent, or Firm*—Smith, Gambrell & Russell, LLP

(57) ABSTRACT

An autogenous grinding mill (10) includes a support casting (12) and a drive motor (14) which rotates a drum (18) defining a generally cylindrical grinding chamber. The other end of the chamber has a discharge opening (22) through which a stationary shaft (24) passes. One or more shear-inducing members (26, 26') are affixed to the shaft (24). A continuous feed of flowable particulate material, for example a slurry or power, is introduced to the rotating grinding chamber via feed passage (28) passing trough the stationary shaft (24). The mill also includes means for introducing a fluid into a layer of material being ground to contact that material. This means can be the same passage (28) used for the feed material or might be a separate passage.

21 Claims, 7 Drawing Sheets

FEED ARRANGEMENT FOR GRINDING MILL INCORPORATING FLUID FEED

The present invention relates to a rotary grinding mill which incorporates means for injecting a fluid into the mass of material being ground.

The invention also relates to a feed arrangement for a rotary grinding mill.

BACKGROUND ART

Conventional rotary mills include a cylindrical drum rotated about a generally horizontal axis. The rotating drum is fed with particulate material such as a slurry or powder, the rotation of the drum being at one half to three quarters of the "critical speed" (ie. the minimum speed at which material at the inner surface of the drum travels right around in contact with the mill). This causes a tumbling action as the feed and any grinding media travels part way up the inner wall of the drum then falls away to impact or grind against other particles in the feed. Size reduction of the particles is thus achieved principally by abrasion and impact.

The present Applicant's International Patent Application No. WO 99/11377 discloses a new grinding mill construction in which a rotary container is spun significantly above critical speed to form a compressed layer of the particulate material retained against the container inner surface, and shear inducing means contacting the layer to induce shearing in the layer. This has been found by the Applicant to create stirred, high shear zones in the compressed material adjacent the shear inducing means, providing a very effective grinding mechanism.

It has now been discovered by the Applicant that this arrangement provides an environment in which chemical reactions or other property-modifying operations may be conducted upon the particulate material being ground in the mill.

The mill described in WO 99/11377 is gravity-fed, the slurry or powder of particulate material entering one end of the rotating grinding container via a feed tube. After grinding, smaller particles migrate radially inwards and pass inside an annular discharge opening it the other end of the mill.

This arrangement works well where gravity feed of the mill is suitable, but would require a sophisticated seal arrangement to allow adaptation of the mill to pressure feed, in view of the high rotary speed of the mill and the abrasive environment.

DISCLOSURE OF THE INVENTION

In one form, the present invention provides a grinding mill for particulate material, including a rotary container having an inner surface, feed means for feeding the particulate material to the container, means rotating the container at a sufficiently high speed that the particulate material forms a layer retained against the inner surface throughout its rotation, and shear inducing means contacting said layer so as to induce shearing in said layer, the grinding mill further including means for introducing a fluid into said layer to contact the particulate material.

Preferably the fluid is injected into said layer in the vicinity of said shear inducing means, and desirably is introduced through said shear inducing means.

Preferably the shear inducing means includes a shaft with at least one projection extending into the particulate layer, the shaft and projection including a passage communicating from a source of said fluid to a position in said layer.

As an alternative, the fluid can be included with the particulate material introduced to the container via said feed means.

A further form of the invention comprises a method of grinding particulate material, including feeding the particulate material to a container which has an inner surface, rotating the container at a sufficiently high speed that the particulate material forms a layer retained against the inner surface throughout its rotation, and contacting the layer with shear inducing means to induce shear in said layer, further including introducing fluid into said layer to contact the particulate material.

Preferably the fluid is injected into said layer.

Alternatively, the fluid is included with the particulate material fed to the container.

In another form, the present Invention provides a grinding mill for particulate material, including a rotary container having an inner surface, feed means for feeding the particulate material to the container, means rotating the container at a sufficiently high speed dial, the particulate material is retained against the inner surface throughout its rotation, and shear inducing means contacting said particular material so as to induce shearing wherein the shear inducing means is non rotational and is mounted on a stationary shaft which passes into the rotary container through a discharge end thereof, with mill discharge opening spacing said shaft from the rotary container, the shaft including the feed means, that introduces the particulate material into the container at a position separated from the discharge end by one or more shear zones created by the shear inducing means, such that the particulate material passes through the shear zone to reach the discharge end.

The feed means can also be used to introduce a fluid with the particulate material to the container.

It will be appreciated that the term "grinding will" as used herein is not to be construed as limited to mills for the primary purpose of substantial particle size reduction, but also includes mills for the purpose of grinding, or attritioning, a freshly exposed surface an the particles before contacting with flotation chemicals or other reagents.

A further form of the invention comprises it method of grinding particulate material, including feeding the particulate material to a container which has an inner surface, rotating the container at a sufficiently high speed that the particulate material is retained against the inner surface throughout its rotation, contacting the particulate material with shear inducing means to induce shear and discharging ground material from the mill through a discharge opening at a discharge end of the container, wherein the shear inducing means is mounted on a stationary shaft passing into said container and spaced from the rotary container by the discharge opening and wherein said feed of particulate material passes through said shaft into said container at a position separated from the discharge end by one or more shear zones created by the shear inducing means.

BRIEF DESCRIPTION OF THE DRAWINGS

Preferred forms of the present invention will now be described by way of example with reference to the accompanying drawings.

DESCRIPTION OF THE INVENTION

Figure 1:
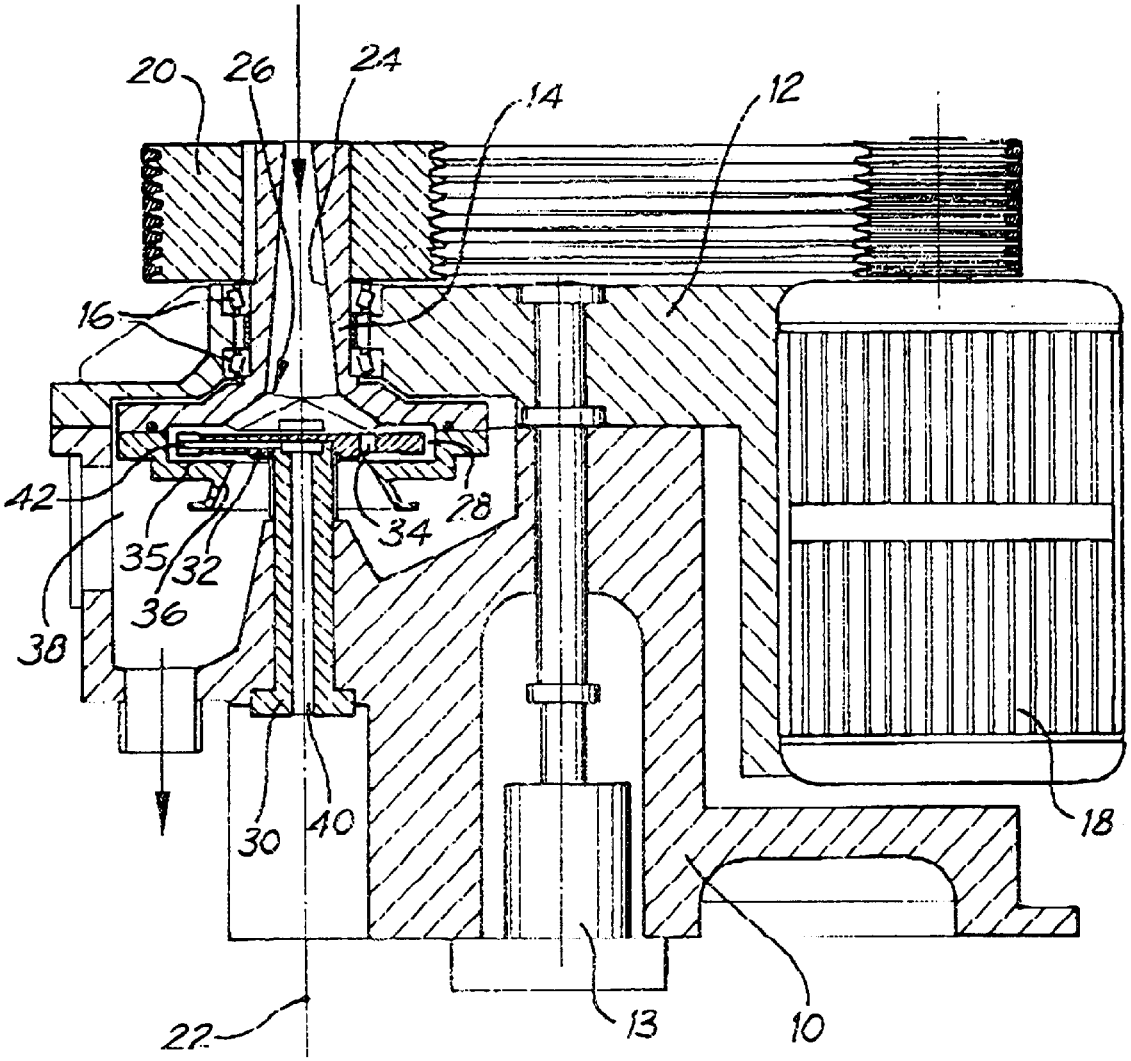
FIG. 1 shows an autogenous grinding mill of the general type described in the present Applicant's International Patent Application No. WO 99/11377, the contents of which are incorporated herein by reference. Details of the construction and operation of such mills are provided in that application.

Referring to FIG. 1 the mill is mounted on a two piece cast housing, the bottom portion 10 of which is fixed while the upper portion 12 may be lifted by hydraulic jack 13 to allow pivoting, to facilitate maintenance of the mill. The upper portion 12 supports the rowing mill drum member 14, via bearings 16, and a drive motor 18 and drive pulley 20 for driving high speed rotation of the drum.

The mill drum member is mounted for high speed rotation on a vertical axis 22, and includes a feed tube 24 and feed impeller 26 for providing particulate material to the grinding chamber 28.

A continuous feed of flowable particulate material, for example a slurry or powder, is introduced to the rotating grinding chamber via feed tube 24, the feed impeller 26 imparting rotary motion to the feed, which is flung outwards to form a layer against the inner surface of the grinding chamber 28. The drum 14 is rotated sufficiently above critical speed that the entire mill charge travels around in contact with the chamber inner surface. The drum 14 is preferably rotated at a speed which will impact an exaggerated "gravitational" force of at least 10 times gravity, and preferably at least 100 times gravity, to the charge. The charge layer is therefore at high pressure, compressed by the high centrifugal force.

The charge layer is mobilised by a stationary shear-inducing member 32 including a disc or finger projections extending into the compressed, rotating charge layer. This leads to the creation of stirred zones in the compressed, solidified charge layer in the vicinity of the stationary projections, causing grinding of the particulate material primarily by a combination of shearing and abrasion fracture as described in WO 99/11377.

A single disc projection 32, mounted on stationary shaft 30, is utilised in the embodiment of FIG. 1.

The larger particles in the charge layer will tend not to move axially though the mill due the high compressive forces on the charge instead radial migration of particles occurs, wherein larger particles introduced in the feed slurry migrate radially outwards through the charge due to the high centrifugal force and are subject to grinding and fracturing by the efficient mechanisms discussed above. As the particle size reduces, the smaller particles migrate radially inwards until they reach the inner free surface of the charge, layer, which equates to a zero (gauge) pressure locus.

The fine particles reaching the free surface may then move axially through the mill, through apertures 34 in the disc, pass radially inwards of the annular retaining plate 35 and discharge ring 36 and into discharge launder 38. If desired, a scraper blade (not shown) may be affixed to stationary shaft 30 to keep the discharged material flowing freely.

The Illustrated mill contains only one grinding disc, hit a plurality of discs or other projections can he used to produce a succession of alternating stirred zone and solid 'dead' zones as described it, WO 99/11377. The fine particles produced in the stirred zone of one disc thus migrate inwardly to the free surface, then axially to the next stirred zone where further size reduction takes place. The grinding therefore takes place in stages along the length of the mill.

If the mill is to be used for non-autogenous grinding, ie. with grinding media, the media will be introduced with the initial charge and retained within the mill radially outwards of the retaining plate 35. However, it is preferred that the mill be operated without grinding media, to prevent any unwanted reactions between the media and the injected fluid.

The mill drum member may he opened to allow access to its interior for replacing the disc, the top portion of the drum including the feed tube, impeller and the upper end of the grinding chamber pivoting away with the upper portion 12 of the housing for ease of access.

The mill illustrated in FIG. 1 further includes means for introducing fluid, such as a gas, liquid or fluidised particles into the charge layer where grinding is taking place. This fluid introduction means includes a passage 40 leading longitudinally through the stationary shaft 30 said radially through the disc to an injection opening 42 at the disc periphery, where the fluid is injected into the charge layer in the region in which it is being ground under high shear. The distal end of the passage 40, at the for end of the shaft 30, is connected to a source of the desired fluid wider high pressure.

The fluid is preferably one which results in a chemical reaction or other property-modifying operation with the particulate material and/or another material in the feed charge. By introducing the fluid to the stirred, high shear region of the mill, the fluid is introduced into the particulate material as it is being ground, and thus is contacted with the freshly exposed surfaces of the ground material to facilitate the chemical reaction or other operation taking place.

Where the mill contains a plurality of discs or other shear-inducing projections causing stirred zones spaced along the mill, fluid is preferably introduced into each of the stirred zones through the respective disc or other projections.

Figure 2:
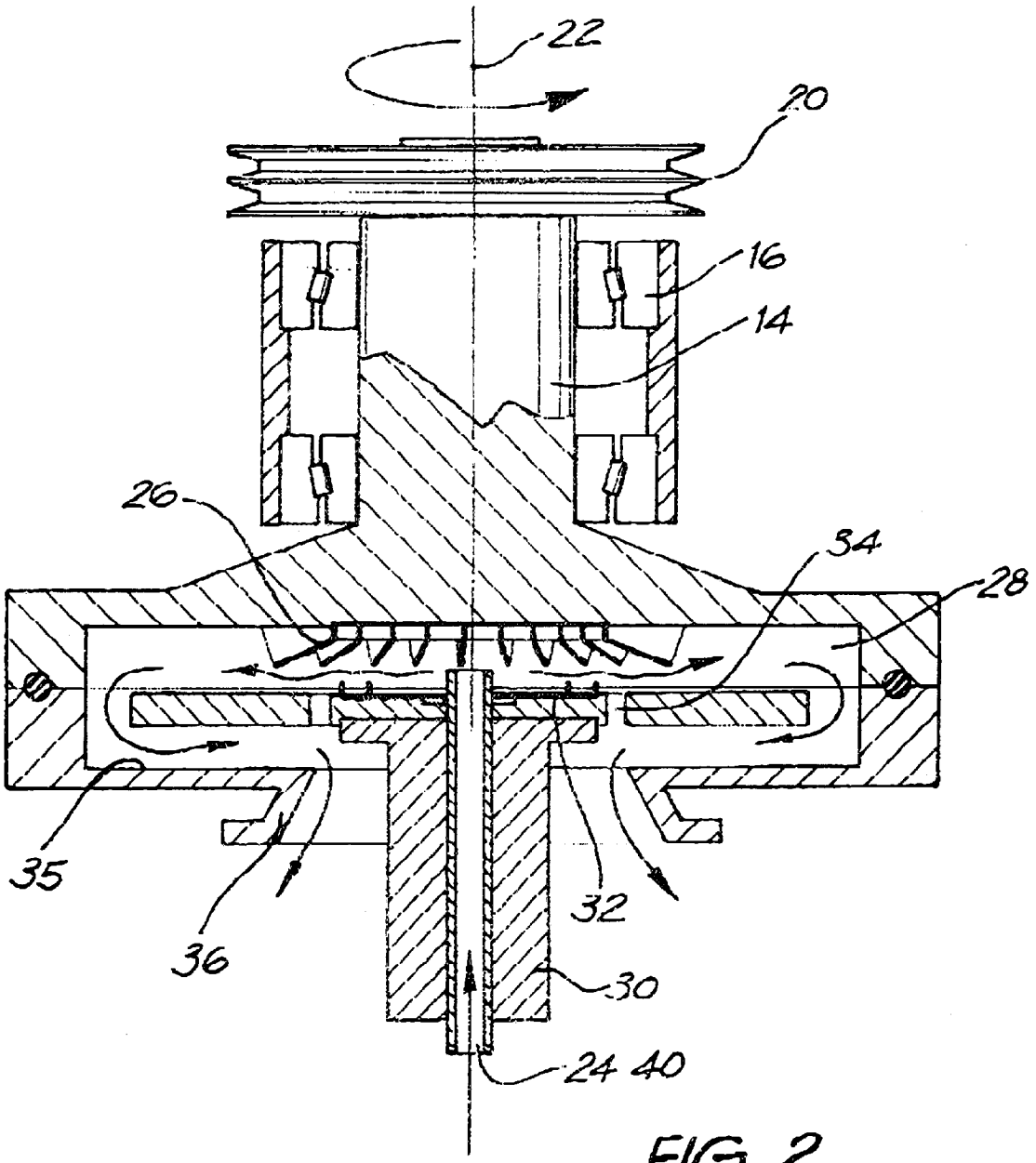
FIG. 2 shows a grinding mill similar to that of FIG. 1, although with the feed from below.

In FIG. 2 there is schematically depicted an embodiment similar to that of FIG. 1, although in this instances, the feed tube 74 and passage 40 are one and the same. That is, the particulate material as well as a fluid additive can be fed to the grinding chamber via it single passage 24, 40. The feed may be pumped into this passage by an external pump or an external or internal screw feeder for example.

Figure 3:
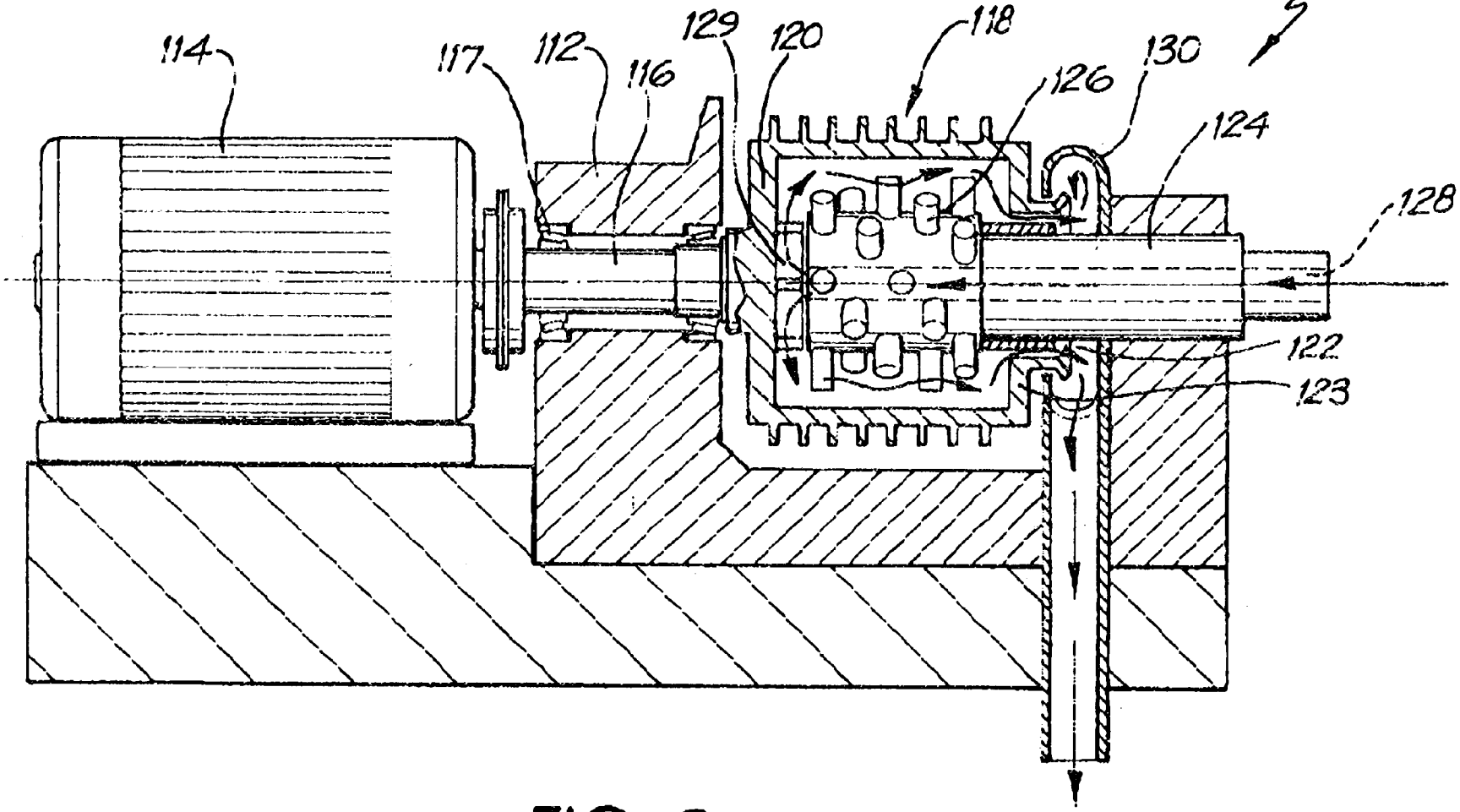
FIG. 3 is a schematic sectional elevation of an embodiment adapted for surface grinding of particulate material.
Figure 4:
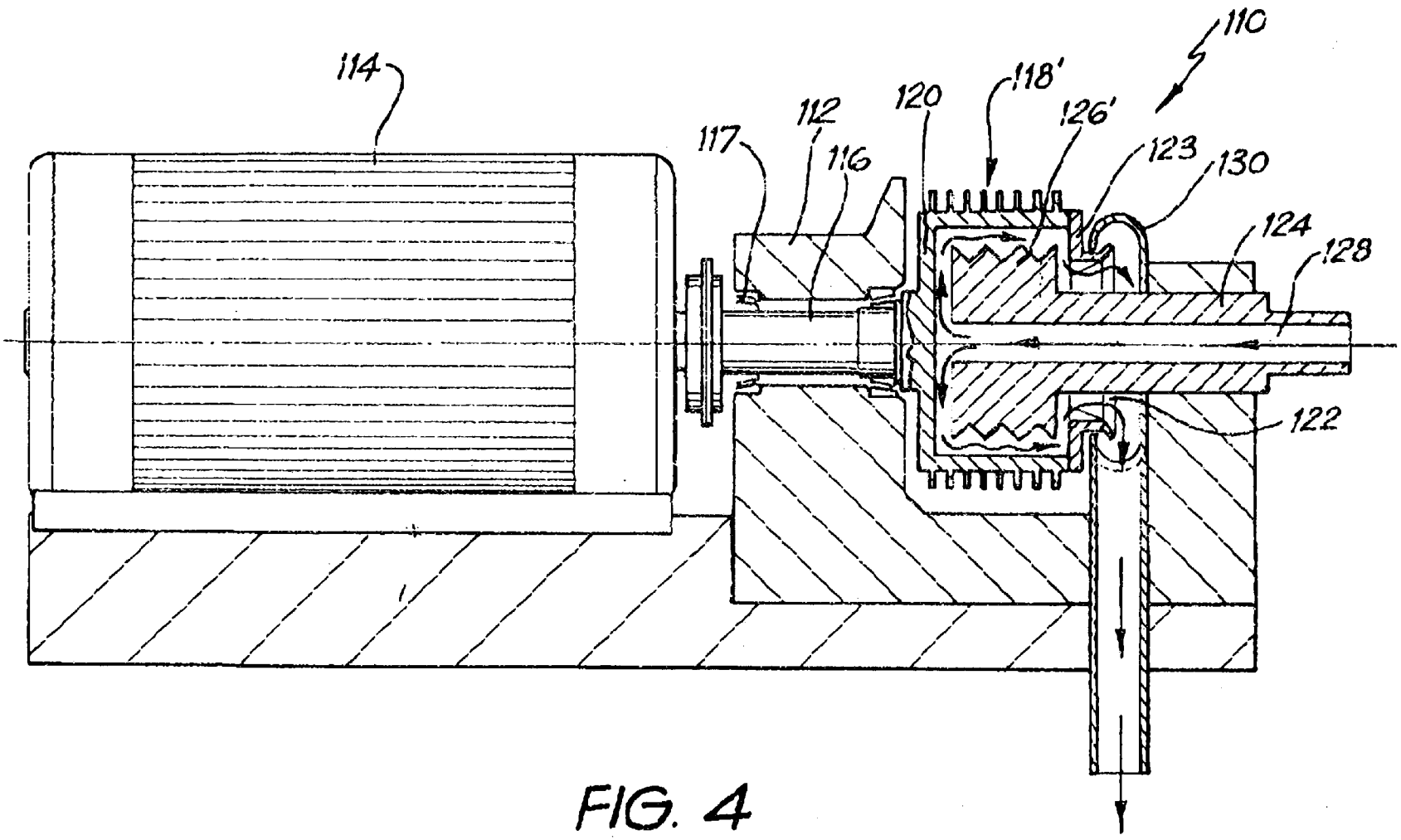
FIG. 4 is a schematic sectional elevation of an embodiment, adapted for particulate size reduction.

Referring to FIGS. 3 and 4, the grinding mill 110 of those figures have the same basic construction, including a support casting 112 and a drive motor 114, drive shaft 116 and bearing 117 arrangement for driving high speed rotation of the grinding drum 118, 118'.

The rotary drum 118, 118' defines a generally cylindrical grinding chamber closed off at the end 120 attached to the drive shaft 116 and having a discharge opening 122 radially inside a discharge ring 123 at its other end. Through this discharge opening passes a stationary shaft 124 which supports one or more shear-inducing members 126, 126'.

An axial feed passage 128 passes trough the stationary shaft 124 and shear-inducing member 126, 126' for introducing the flowable particulate material to the grinding chamber at a position between the shear member and the closed off end 120 of the drum 118. The inner surface of this closed off end may carry a feed impeller 129 (FIG. 3) for imparting rotary motion to the feed.

A continuous feed of flowable particulate material, for example a slurry or powder, is introduced to the rotating grinding chamber via feed passage 128, the feed impeller 129 flings the material outwards to form a layer against the inner surface of the grinding chamber.

As the teed is introduced to A position beyond the shear members, the material must pass through the shear zones created by these members before it can escape the mill. Also, because the feed is introduced through the stationary shaft, which in turn is spaced from contact with the rotating container via the annular discharge opening 122, the feed material can be supplied to the mill under pressure simply by connecting the feed passage 128 to a pump discharge, without the need to provide rotary seals between the feed passage and the rotary container.

The drum is rotated sufficiently above critical speed that the entire will charge travels around in contact with the chamber inner surface.

The optimal drum speed and shear member construction will depend on the material to be ground and the desired result. For example, the, mill of FIG. 2 is designed to be rotated at lower speed, eg. imparting 3–5 times gravity force, consistent with its purpose for surface grinding of the particles such as to form a freshly exposed surface for contacting floatation reagents or similar. These reagents may be introduced with the feed. When particle size reduction is the primary objective (FIG. 3), the drum is preferably rotated at a speed which will impart an exaggerated "gravitational" force of at least 10 times gravity, and preferably at least 100 times gravity, to the charge. The charge layer is therefore At high pressure, compressed by the high centrifugal force.

The charge layer is mobilised by a stationary shear-inducing member including a disc, pin or finger projections extending into the compressed, rotating charge layer. This leads to the creation of stirred zones in the compressed, solidified charge layer in the vicinity of the stationary projections, causing grinding of the particulate material primarily by a combination of shearing and abrasion fracture as described in WO 99/11377.

A multitude of pin projections are utilised in the shear member in the embodiment of FIG. 3, whereas a profiled shearing drum and more compact grinding chamber are used in FIG. 4.

The larger particles in the charge layer will tend not to move axially at the outer edge of the mill due the high compressive forces on the charge. Instead radial migration of particles occurs, wherein larger particles introduced in the feed slurry migrate radially outwards through the charge due to the high centrifugal force and art subject to grinding and fracturing by the mechanisms discussed above. As the particle size reduces, the smaller particles migrate radially inwards to the lower 'gravity' part of the, mill. The fine particles may then move axially through the mill, pass radially inwards of the discharge ring 123 the and into discharge launder 130. If desired, a scraper blade (not shown) may be affixed to stationary shaft 124 to keep the discharged material flowing freely.

The illustrated mills contain only one grinding disc, but a plurality of discs 126" (FIG. 5) or other projections car be used to produce a succession of alternating stirred zone and solid 'dead' zones as described in said WO 99/11377. The fine particles produced in the stirred zone of one disc thus migrate inwardly then axially to the next stirred zone where further size reduction takes place. The grinding therefore takes place in stages along the length of the mill.

If the mill is to be used for non-autogenous grinding, ie. with grinding media, the media will be introduced with the initial charge and retained within the mill radially outwards of the discharge opening. However, it is preferred that the mill be operated without grinding media, to prevent any unwanted reactions between the media and any injected flotation reagents.

Figure 5:
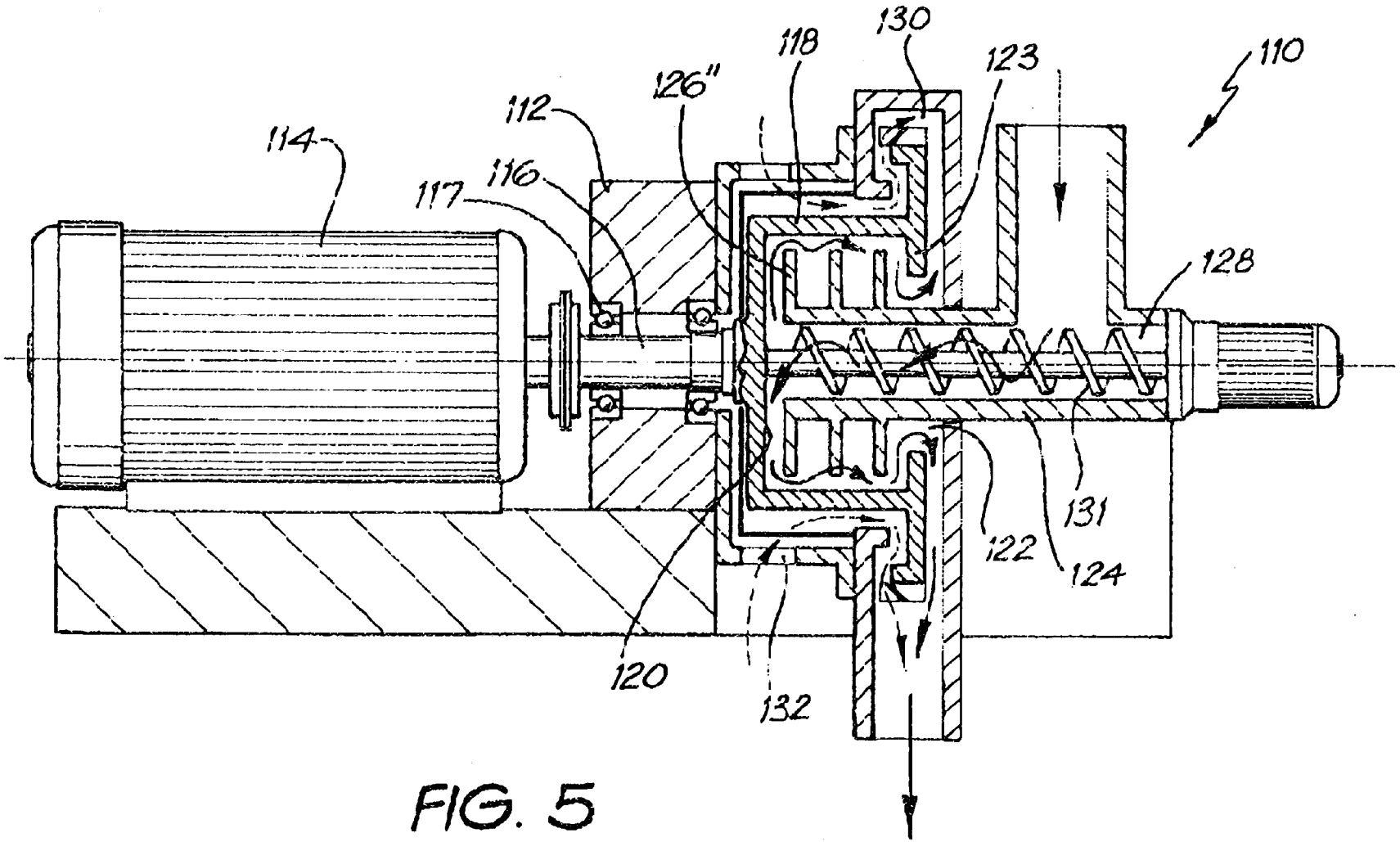
FIG. 5 is a schematic sectional elevation of an embodiment incorporating a screw feeder.

FIG. 5 illustrates a mill similar to those of FIGS. 3 and 4, but including a screw feeder 131 within the feed passage 128 for feeding particulate material as well as fluid additives or chemical additives if required. Also in this embodiment there are shown three discs 126" as an alternative to the arrangements of FIGS. 3 and 4.

This embodiment also shows air flow passages 132 for cooling and assisting product extraction. Water cooling might be used as an on alternative.

Figure 6:
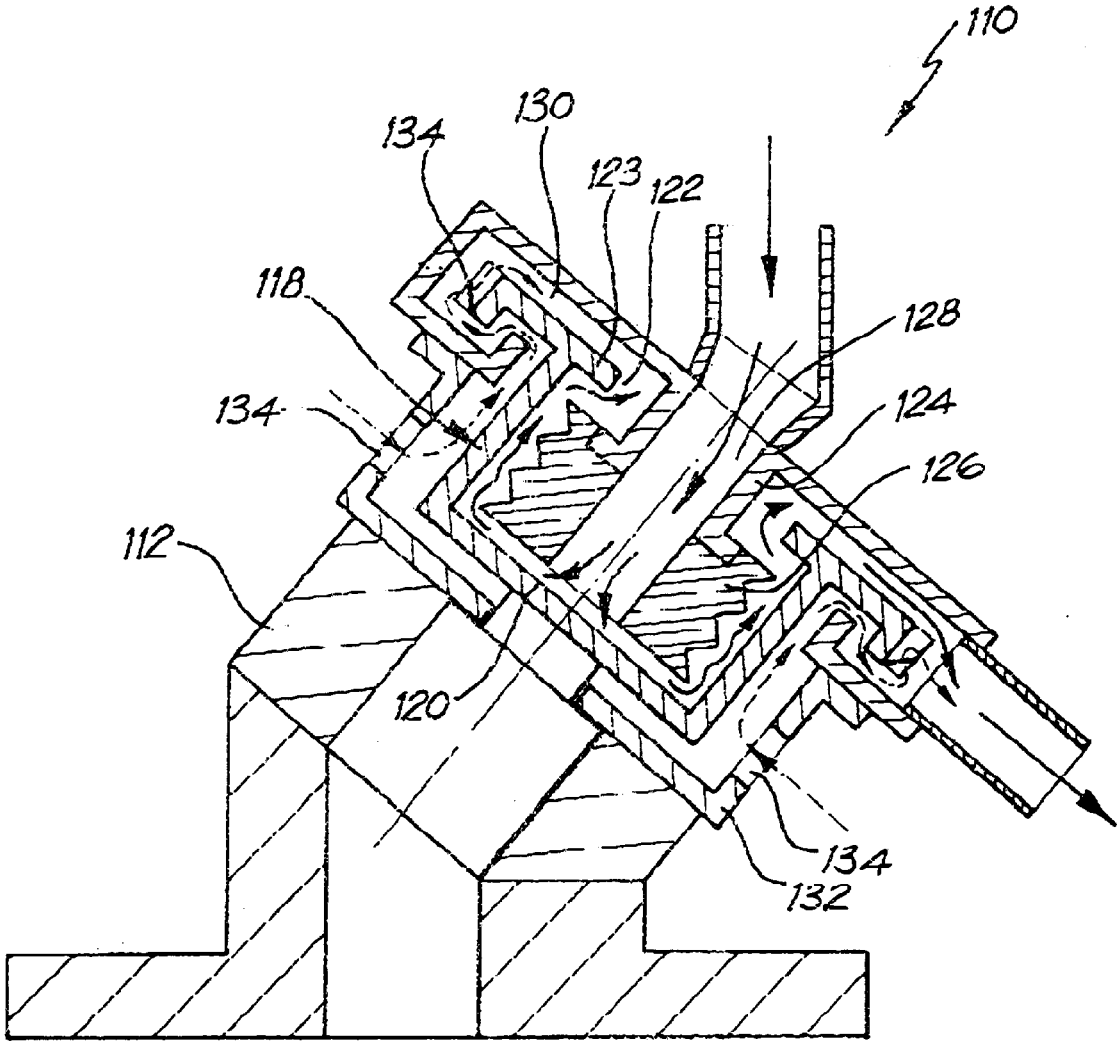
FIG. 6 Is a schematic sectional elevation of an embodiment, mounted on an inclined axis.

FIG. 6 shows a grinding mill mounted on in inclined axis, but otherwise similar in general construction and operation to the mill of FIG. 4. The rotary drum 118 is surrounded by a stationary housing 132 which defines both an air-cooling a jacket for the drum and a discharge launder 130. The discharge ring 123 of the rotary drum is extended radially outwards and has air vanes 134 at its periphery for drawing a flow of cooling air through apertures 136 in the housing 132 and across the outer surface of the drum. This air flow also assists removal of the ground product from the discharge launder.

Figure 7:
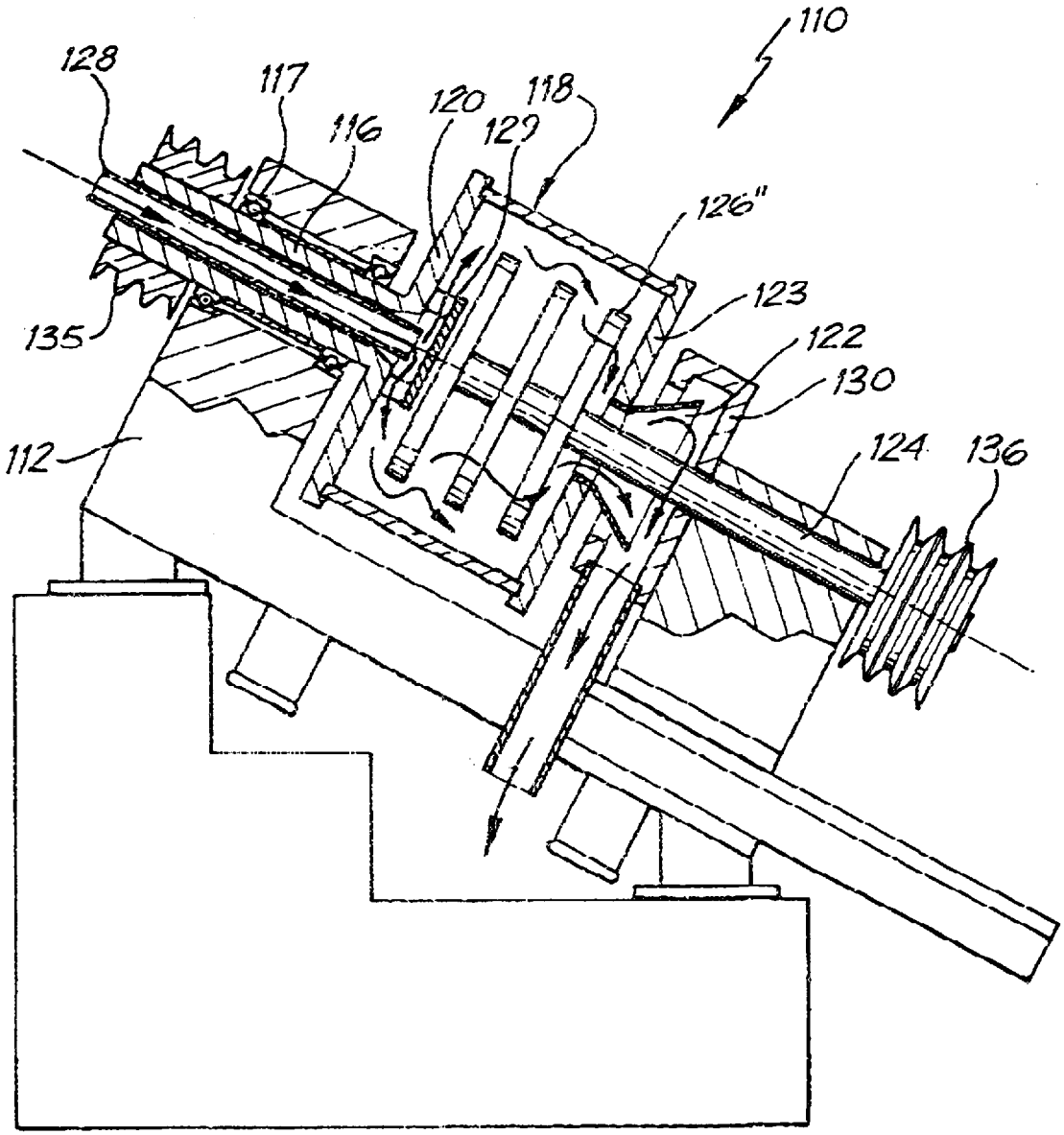
FIG. 7 is a schematic sectional elevation of another embodiment, mounted on an inclined axis.

In FIG. 7 there is schematically depicted a grinding mill also mounted on an inclined axis but including three discs 126" which can be rotating or fixed. For the purpose of rotating these discs, a drive pulley 136 is attached to the shaft on which the discs 126" are mounted. There is also provided another drive pulley 135 which is driven to rotate the chamber within which the 126" are located. There is a fixed, non-rotational feed tube 128 passing through the drive pulley 135 and which might optionally include a screw feeder on assist in feeding the particulate material to the grinding chamber. The drive pulleys 135 and 136 might be driven to rotate in the same direction, though with one rotating at a speed higher than the other, or might be driven to rotate in reverse directions.

While particular embodiments of this invention have been described, it will be evident to those skilled in the art that the present invention way be embodied in other specific forms without departing from the essential characteristics thereof. The present embodiments and examples arc therefore to be considered in all respects as illustrative and not restrictive, and all modifications which would be obvious to those skilled in the art are therefore intended to be embraced therein.

I claim:

1. A grinding mill for grinding of a particulate material, including a rotary container having an inner surface, feed means for feeding the particulate material to the container, means rotating the container at a sufficiently high speed that the particulate material forms a layer retained against the inner surface throughout its rotation, and shear inducing means contacting said layer so as to induce shearing in said layer, the grinding mill further including means for introducing a property-modifying fluid into said layer to contact the particulate material.

2. The grinding mill of claim 1 wherein the fluid is injected into said layer in the vicinity of said shear inducing means.

3. The grinding mill of claim 2 wherein the fluid is introduced through said shear inducing means.

4. The grinding mill of claim 1 wherein the shear inducing means includes a shaft with at least one projection extending into the particulate layer, the shaft and projection including a passage communicating from a source of said fluid to a position in said layer.

5. The grinding mill of claim 1 in wherein the fluid is included with the particulate material introduced to the container via said feed means.

6. The grinding mill of claim 1 wherein the feed means includes a screw feeder.

7. The grinding mill of claim 1 wherein the feed means for feeding the particulate material to the container is a passage through a non-rotational shaft upon which said shear inducing means is mounted.

8. The grinding mill of claim 2 wherein the feed means for feeding the particulate material to the container is a passage through a non-rotational shaft upon which said shear inducing means is mounted.

9. The grinding mill of claim 3 wherein the feed means for feeding the particulate material to the container is a passage through a non-rotational shaft upon which said shear inducing means is mounted.

10. The grinding mill of claim 4 wherein the feed means for feeding the particulate material to the container is a passage through a non-rotational shaft upon which said shear inducing means is mounted.

11. The grinding mill of claim 5 wherein the feed means for feeding the particulate material to the container is a passage through a non-rotational shaft upon which said shear inducing means is mounted.

12. The grinding mill of claim 6 wherein the feed means for feeding the particulate material to the container is a passage through a non-rotational shaft upon which said shear inducing mean, is mounted.

13. A method of grinding particulate material, including feeding the particulate material to a container which has an inner surface, rotating container at a sufficiently high speed that the particulate material forms a layer retained against the inner surface throughout its rotation, and contacting the layer with shear inducing means to induce shear in said layer to grind the particulate material, further including introducing a property-modifying fluid into said layer to contact the particulate material.

14. The method of claim 13 wherein the fluid is injected into said layer.

15. The method of claim 13 wherein the fluid is included with the particulate material fed to the container.

16. The method of claim 13 wherein the grinding of the particulate material is carried out in an environment free of grinding media.

17. A grinding mill for particulate material including a rotary container having an inner surface, feed means for feeding the particulate material to the container, means rotating the container at a sufficiently high speed that the particulate material is retained against the inner surface throughout its rotation, and shear inducing means contacting said particulate material so as to induce shearing, wherein the shear inducing means is non-rotational and is mounted on a stationary shaft which passes into the rotary container through a discharge end thereof, with a mill discharge opening spacing said shaft from the rotary container, the shaft including the feed means, introducing the particulate material into the container at a position separated from the discharge end by one or more shear zones created by the shear inducing means, such that the particulate material passes through the shear zone to reach the discharge end.

18. The grinding mill of claim 17 wherein the feed means is used to introduce a with the particulate material to the container.

19. The grinding mill of claim 17 wherein the feed means includes a screw feeder.

20. A method of grinding particulate material, including feeding the particulate material to a container which has an inner surface, rotating the container at a sufficiently high speed that the particulate material is retained against the inner surface throughout its rotation, contacting the particulate material with shear inducing means to induce shear and discharging ground material from the mill through a discharge opening at a discharge end of the container, wherein the shear inducing means is mounted on a stationary shaft passing into said container and spaced from the rotary container by the discharge opening, and wherein said feed of particulate material passes through said shaft into said container at a position separated from the discharge end by one or more shear zones created by the shear inducing means.

21. The method of claim 20 wherein the grinding of the particulate material is carried out in an environment free of grinding media.

* * * * *